United States Patent [19]

Ito et al.

[11] Patent Number: 4,935,781

[45] Date of Patent: Jun. 19, 1990

[54] IMAGE FORMING APPARATUS HAVING COLOR EDITING FUNCTION

[75] Inventors: Kouji Ito; Takao Fujiwara, both of Toyokawa; Akihiro Nishida, Shinshiro, all of Japan

[73] Assignee: Minolta Camera Kabushiki Kaisha, Osaka, Japan

[21] Appl. No.: 120,595

[22] Filed: Nov. 13, 1987

[30] Foreign Application Priority Data

Nov. 13, 1986 [JP] Japan ..... 61-270778

[51] Int. Cl.[5] ..... G03G 15/08

[52] U.S. Cl. ..... 355/245; 355/253; 355/328

[58] Field of Search ..... 355/3 R, 3 DD, 4, 7, 355/200, 210, 218, 245, 251, 253, 326, 328; 118/639, 645, 653, 656, 657, 658, 661

[56] References Cited

U.S. PATENT DOCUMENTS

| | | | |
|---|---|---|---|
| 2,910,963 | 11/1959 | Herman | 118/657 X |
| 3,914,043 | 10/1975 | McVeigh | 355/4 |
| 3,960,445 | 6/1976 | Drawe | 355/4 |
| 4,373,798 | 2/1983 | Tsukada et al. | 355/3 DD |
| 4,572,102 | 2/1986 | Yuge et al. | 118/689 |
| 4,641,602 | 2/1987 | Kasai | 355/653 |
| 4,657,376 | 4/1987 | Ide | 355/14 R |
| 4,685,794 | 8/1987 | Watanabe | 355/7 |
| 4,743,946 | 5/1988 | Nishimori et al. | 355/14 C |

FOREIGN PATENT DOCUMENTS

| | | |
|---|---|---|
| 48-22212 | 7/1973 | Japan . |
| 60-170868 | 9/1985 | Japan . |
| 61-72270 | 4/1986 | Japan . |
| 61-203474 | 9/1986 | Japan . |

*Primary Examiner*—Fred L. Braun

*Attorney, Agent, or Firm*—Burns, Doane, Swecker & Mathis

[57] ABSTRACT

An image forming apparatus which includes a color editing function is provided with two developing units, each of the developing units contain an impeding device for impeding flow of the developer as it is transported on a peripheral surface of the developing sleeve locally in the axial direction of the roller. An image editing device is provided for specifying an optical area of a desired image to be produced and a controller is provided for controlling the developing units so as to permit development of a specified area by one developing unit and to develop any unspecified area by the other developing unit.

10 Claims, 9 Drawing Sheets

IMAGE FORMING APPARATUS HAVING COLOR EDITING FUNCTION

BACKGROUND OF THE INVENTION

The present invention relates to an image forming apparatus incorporating a developing device for use with powders and having a multicolor image editing function.

Developing units are in wide use which comprise a developing sleeve having incorporated therein a plurality of magnets extending axially thereof, and a bristle height restricting member opposed to and spaced from the outer peripheral surface of the developing sleeve. A magnetic developer is supplied to the outer peripheral surface of the developing sleeve and transported in the form of a magnetic brush, with the amount of transport controlled by the restricting member.

On the other hand, copying machines having various functions have been proposed in recent years. These copying machines include twin color copying machines which have two developing units of the above type provided around a photosensitive drum and containing developers of different colors. The color copying machine has a two-color image editing function, such that a portion of a document image is developed in one of the colors and the other portion thereof in the other color.

However, when the above function is to be performed, there is a need to execute twice an image forming process comprising the sequence of steps of charging, exposure, local erasure, development, transfer and fixing and to provide a return path of transport through which copy paper having an image formed thereon by the first cycle of the process is guided to the second cycle of the process. This entails the problem that the apparatus becomes large-sized, complex in construction and costly.

Another problem is also encountered. Since the copy paper is subjected to the image forming process twice in succession and therefore to mechanical and thermal stresses, the paper is prone to curling and damage, consequently jamming the apparatus or causing displacement of the image.

The apparatus has another problem in that it requires for copying approximately twice the time needed for single-color copying and is extremely low in processing efficiency per unit time.

SUMMARY OF THE INVENTION

The main object of the present invention is to provide an image forming apparatus which is adapted to perform a multicolor image editing function reliably, easily within a short period of time.

Another object of the invention is to provide a developing device which is adapted to develop an image of a document in different colors only locally.

To fulfill the above objects, the image forming apparatus of the invention comprises:

a rotatable photosensitive member having a photosensitive layer over its peripheral surface, means for forming on the photosensitive member an electrostatic latent image corresponding to the desired image, image editing means for specifying an optional area of the desired image;

a first developing unit having a developing roller for developing the latent image on the photosensitive member by bringing a developer being transported on the peripheral surface of the roller into contact with the latent image, first impeding means provided within the first developing unit for impeding the flow of the developer being transported on the peripheral surface of the developing roller locally in the axial direction of the roller, a second developing unit having a developing roller for developing the latent image on the photosensitive member by bringing a developer being transported on the peripheral surface of the roller into contact with the latent image, second impeding means provided within the second developing unit for impeding the flow of the developer being transported on the peripheral surface of the developing roller locally in the axial direction of the roller, and control means for driving the first impeding means so as to contact the developer with the latent image only at a portion thereof corresponding to the area specified by the image editing means and for driving the second impeding means so as not to contact the developer with the latent image at least at the portion thereof corresponding to the specified area.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the seveal drawings.

DETAILED DESCRIPTION OF THE INVENTION

The present invention will be described with reference to the accompanying drawings.

Figure 1:
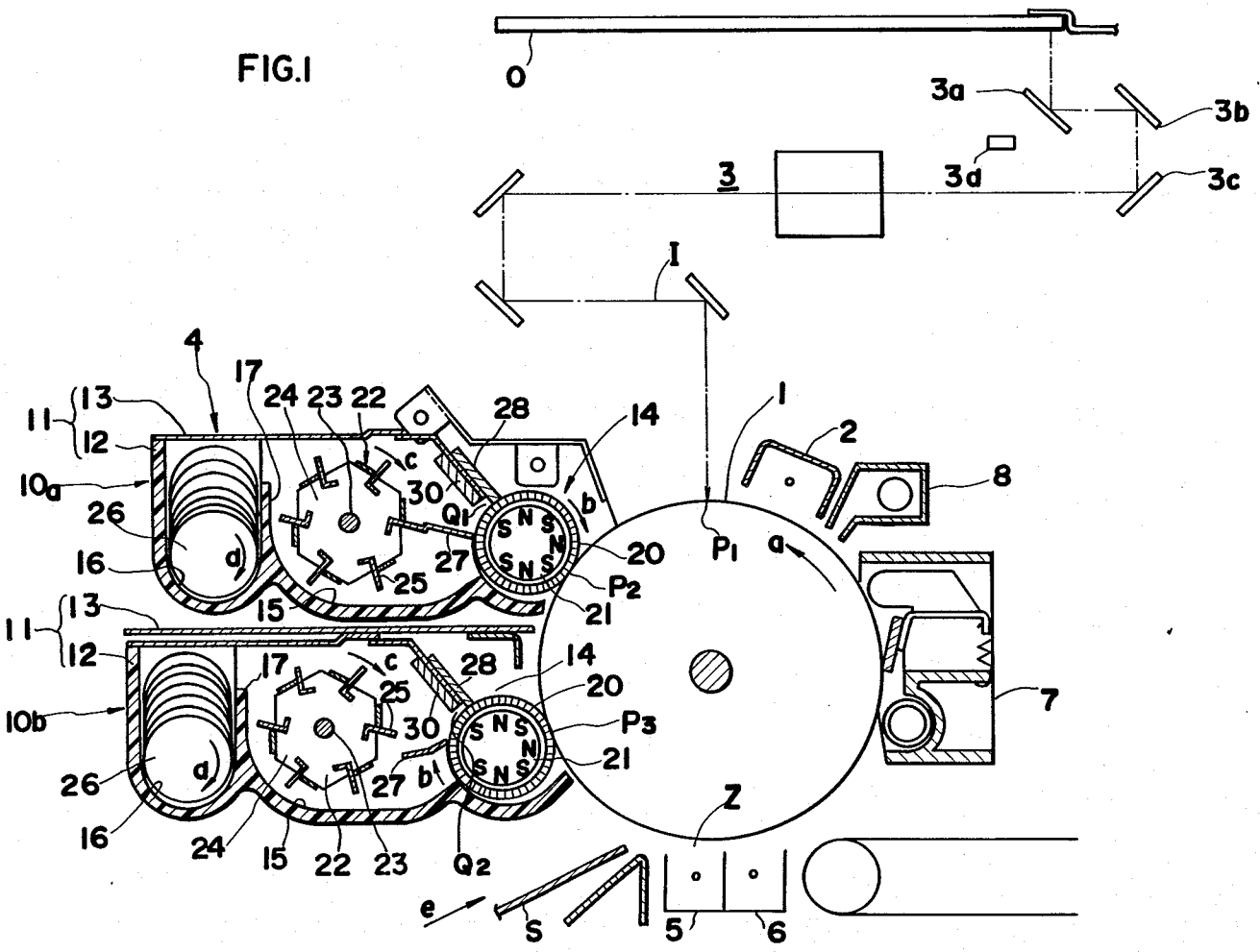
FIG. 1 is a sectional view showing an electrophotographic copying machine according to a first embodiment of the invention.

FIG. 1 shows the latent image forming assembly and developing device of a multicolor image forming apparatus, i.e. a two-color copying machine. The construction of the copying machine will be described first generally.

A photosensitive drum 1 is drivingly rotatable in the direction of arrow a. Provided around the drum 1 are a sensitizing charger 2, developing device 4, transfer charger 5, separating charger 6, cleaner 7 and eraser lamp 8, these components being arranged in the order mentioned toward the direction of rotation.

Disposed above these components is an optical system 3 including a first mirror 3*a* and second and third mirrors 3*b*, 3*c* which are movable for scanning at a speed ratio of 2:1. The first mirror 3*a* is initiated into the scanning movement a predetermined distance upstream from the front end of the document to be placed on a document support glass plate 0, i.e. a distance required for the mirror to travel at a specified speed after starting from its stopped position plus an allowance distance, upstream from the document end. Disposed on the path of scanning movement is a document end detecting switch 3*d* opposed to the document end. After the start of scanning movement, a support for the first mirror 3*a* turns on the detecting switch 3*d*, which in turn feeds a signal to a CPU (see FIG. 3) serving as a control unit.

With the copying machine of the above construction, the drum 1 is rotated at a specified speed in the direction of arrow a. The surface of the drum 1 in rotation is first uniformly sensitized by the charger 2 and then exposed to image light I corresponding to the document on the glass plate 0 by the optical system 3, whereby an electrostatic latent image is formed on the surface. Toner is then supplied to the drum surface by the developing device 4 to develop the latent image to a toner image.

On the other hand, copy paper S is fed to a transfer station Z in the direction of arrow e as timed with the toner image on the drum 1, has the toner image transferred thereto by the discharge of the transfer charger 5, then separated from the drum 1 by the separating charger 6, thereafter passed through an unillustrated fixing unit and discharged onto a discharge tray.

While in continued rotation, the drum 1 has the residual toner scraped off therefrom by the cleaner 7, further exposed to the light from the eraser lamp 8 for the removal of residual charge and made ready for the subsequent copying cycle.

The developing device 4 will be described next.

The developing device 4 comprises first and second developing units 10*a* , 10*b* embodying the invention and identical in construction. The first developing unit 10*a* contains a first developer composed of a color toner and a magnetic carrier in mixture. The second developing unit 10*b* contains a second developer composed of a black toner and a magnetic carrier. These units are arranged along the direction of rotation (indicated by the arrow a) of the drum 1, with the first unit 10*a* positioned upstream from the other unit 10*b*.

Each of the developing units 10*a*, 10*b* generally comprises a developing tank 11 composed of a casing 12 and a cover 13, and a developing sleeve accommodating portion 14 and transport channels 15, 16 which are formed inside the tank 11, arranged rearward away from the drum 1 and accommodate a developing sleeve 20, a bucket roller 22 and a transport roller 26, respectively.

The transport channels 15, 16 are separated by a partition plate 17 extending upward from the bottom of casing 12 but are in communication with each other through passages at their near ends (close to the plane of FIG. 1) and the remote ends.

The developing sleeve 20 is in the form of a hollow cylinder of an electrically conductive nonmagnetic material, such as aluminum, has minute projections or indentations over its outer peripheral surface and is drivingly rotatable in the direction of arrow b. Fixedly provided inside the sleeve 20 is a magnetic roller 21 having S and N poles arranged alternately circumferentially thereof and extending in the axial direction. However, poles of the same polarity are adjacent to each other where the roller 21 is opposed to the bucket roller 22 in the rear.

A developer guide plate 27 supported by the side walls of the casing 12 is provided between the developing sleeve 20 and the bucket roller 22.

The bucket roller 22 comprises a plurality of transport blades 24 mounted on a shaft 23 and a plurality of buckets 25 attached to outer portions of the blades 24 and is drivingly rotatable in the direction of arrow c for transporting the developer within the channel 15 from the remote end toward the near end while agitating the developer to partially supply the developer to the surface of the developing sleeve 20 via the guide plate 27.

The transport roller 26 is drivingly rotatable in the direction of arrow d, whereby the developer transferred from the channel 15 to the channel 16 through the passage (not shown) at their near ends is transported from its near end toward the remote end while being agitated. Upon reaching the remote end, the developer is sent by the roller 26 into the channel 15 through the passage (not shown) at the channel remote ends.

A bristle height restricting plate 28 attached to the cover 13 and positioned above the developing sleeve 20 obliquely rearward thereof is opposed to the sleeve 20 with a predetermined gap formed therebetween. An electromagnetic array 30 is provided on the restricting plate 28 on the upstream side thereof with respect to the direction of rotation of the developing sleeve.

Figure 2:
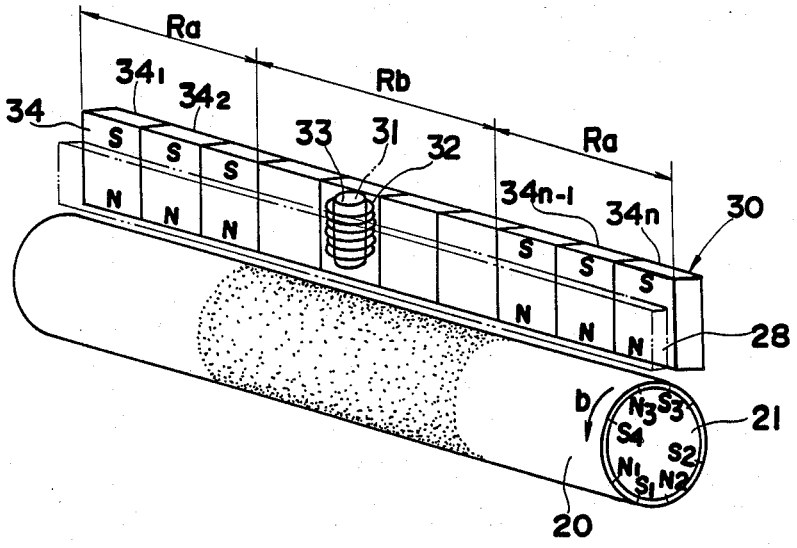
FIG. 2 is a persepctive view showing an array of electromagnets according to the first embodiment.

As seen in detail in FIG. 2, the electromagnetic array 30 has a plurality of electromagnetic blocks 34 ($34_1$ to $34_n$) each incorporating an electromagnet 33 formed by providing a coil 32 around a magnetic core 31 such as an iron core. The pole face of the magnet 33 is opposed to the sleeve 20.

Figure 3:
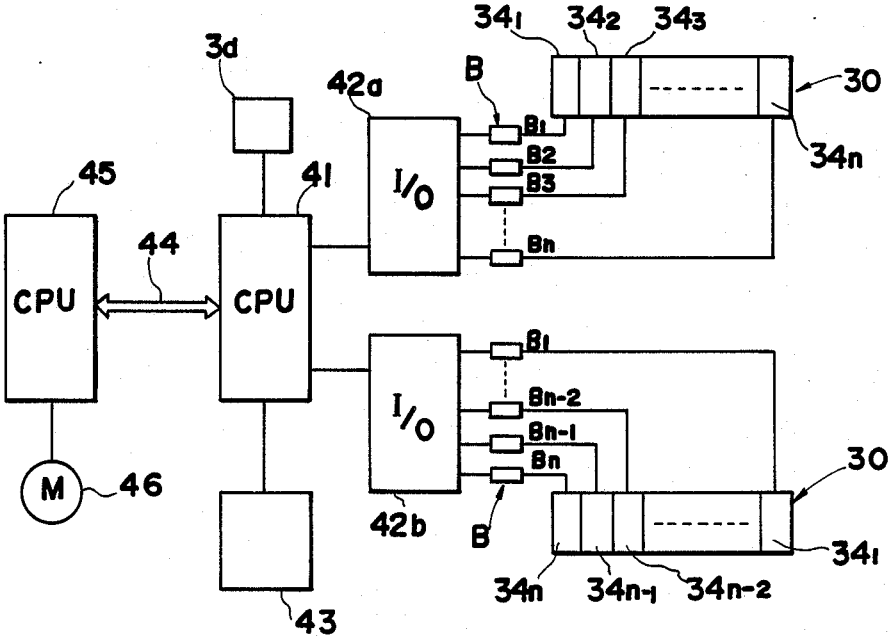
FIG. 3 is a diagram showing the control circuit of the first embodiment.

All the coils 32 are wound in the same direction, and the opposite ends thereof are connected to the control circuit of FIG. 3. With the present embodiment, the magnetic core 31 is magnetized to N polarity at the side thereof opposed to the developing sleeve 20 when the coil 32 is energized.

With reference to the control circuit of FIG. 3, the CPU 41 has connected thereto an input unit 43 which is operated by keys on the control panel to be described below of the copying machine.

Also connected to the CPU 41 are the document end detecting switch 3*d* and two input-output ports (I/O ports) 42*a* and 42*b*. The I/O ports 42*a*, 42*b* have terminals connected via buffers B ($B_1$ to $B_n$) to the electromagnetic blocks 34 ($34_1$ to $34_n$) of the first developing unit 10*a* and the second developing unit 10*b*, respectively. In response to signals from the input unit 43, the electromagnets 33 are individually magnetized or demagnetized.

Another CPU 45 is connected to the CPU 41 by a bus 44. An unillustrated scan motor 46 of the optical system 3 is further connected to the CPU 45.

Figure 4:
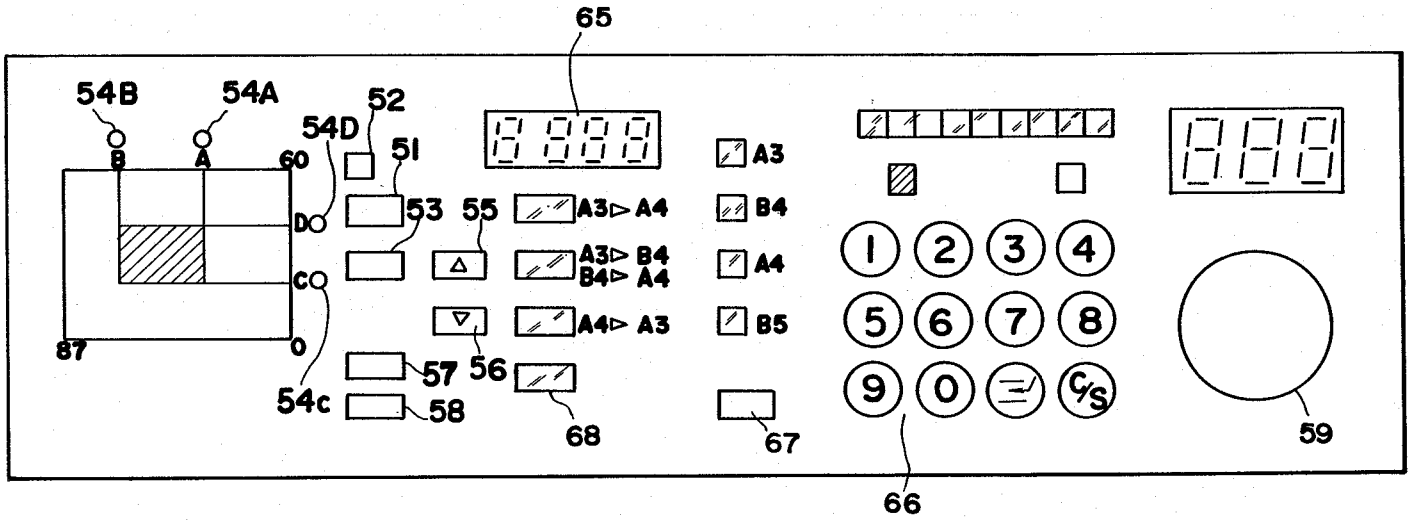
FIG. 4 is a view showing the operation panel of the first embodiment.

FIG. 4 shows an operation panel 50 having an edition mode key 51 and an edition mode display 52. When the edition mode key 51 is depressed, an edition mode is set for a color change of a portion of the document image specified by coordinate setting. When the key is depressed again, the edition mode is canceled.

Disposed under the edition mode key 51 is a coordinate setting selection key 53 for setting the desired coordinates. Every time the key 53 is depressed while the edition mode display 52 is on in the edition mode, display portions 54A, 54B, 54C and 54D for coordinate settings A, B, C and D are turned on one after another, such that a particular coordinate can be set for the display portion that is on by manipulating an up key 55 and a down key 56. When the coordinates for the display portions 54A to 54D have been set, the setting of the coordinates for the positions of four sides is completed for edition, whereby an area for color change is specified. A data display 65 indicates the coordinate values thus set.

Color selection keys 57 and 58 are provided under the coordinate setting selection key 53. In the usual mode, images are developed in the selected color, while in the edition mode, the area other than the area specified by coordinate settings is developed in the selected color.

FIG. 4 further shows a print key 59 for starting a copying operation, ten numerical keys 66 for setting the number of copies to be obtained, a paper selection key 67 and a magnification selection key 68.

In each of the developing units **10*a*, 10*b* of the foregoing construction, the developer is transported through the channels 15, 16 via the passages (not shown) at the opposite ends of the partition wall 17 in circulation by the bucket roller 22 and the transport roller 26 while being agitated in the channels, and is partially supplied to the surface of the developing sleeve 20 by the bucket roller 22 via the developer guide plate 27**.

The developer supplied to the sleeve 20 is transported in the direction of arrow b in the form of a magnetic brush along the lines of magnetic force produced by the magnetic roller 21, has its bristle height regulated by the restricting plate 28 and brought into rubbing contact with the electrostatic latent image formed on the surface of the photosensitive drum 1 at a developing station P2 (P3) to convert the image to a visible image.

At the position Q1 (Q2) where the developing sleeve 20 is opposed to the electromagnetic array 30, the developer is removed from the surface of the sleeve 20 at the portions thereof opposed to "on" regions Ra of blocks 34 with magnetized magnets 33 as shown in FIG. 2 owing to the lines of magnetic force produced by the magnets 33 and is thereby prevented from being transported further downstream. On the other hand, at the sleeve portion opposed to an "off" region Rb of blocks 34 with demagnetized magnets 33, the developer is transported to the developing station P2 (P3) with the rotation of the developing sleeve 20 to develop the latent image on the drum 1.

In this way, the electromagnets 33 are turned on and off with controlled timing in response to signals from the input unit 43 to control the widths and positions of the on region Ra and off region Rb, whereby the specified area only of the document can be reproduced. Further the on region Ra and the off region Rb for the first developing unit **10*a* are made to correspond to the off region Rb and the on region Ra for the second developing unit 10*b* , respectively, to copy a portion of one document with the color toner of the first developing unit 10*a*, and the other portion thereof with the usual black toner of the second developing unit 10*b***, whereby an image of different colors can be edited.

Figure 5:
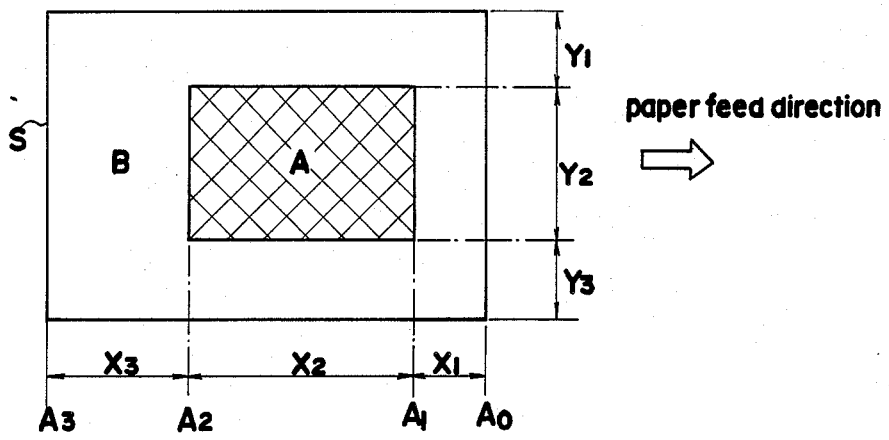
FIG. 5 is a diagram showing a mode of editing an image.

With reference to FIG. 5 and the timing chart of FIG. 6, a copying operation will be described below wherein an image area A is copied in a color, and another image area B in black using the foregoing copying machine.

First, keys on the operation panel 50 are manipulated to specify the sizes of the areas A and B in accordance with the size of copy paper S and the color. More specifically, the widths X1, X2, X3 in the direction of transport of the paper and the widths Y1, Y2, Y3 widthwise of the paper, i.e. perpendicular to the transport direction are entered. Data is also entered to the effect that the area A is to be developed by the first developing unit **10*a*, and the area B by the second unit 10*b***.

Figure 6:
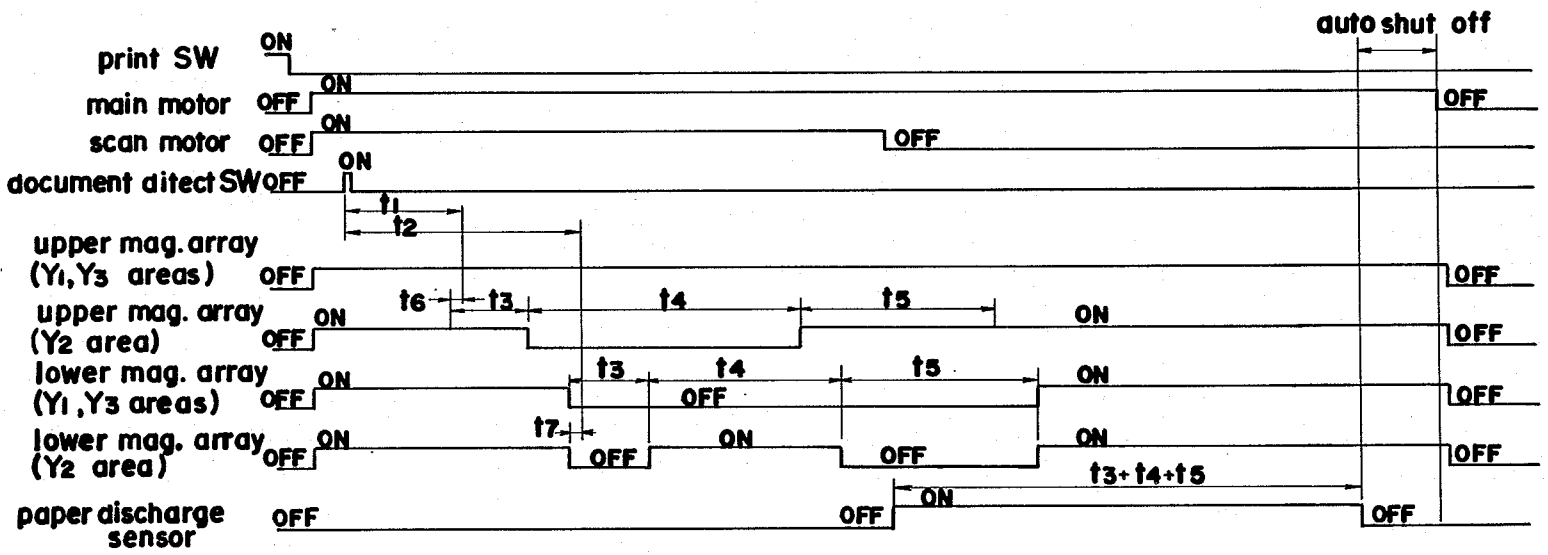
FIG. 6 is a timing chart showing the operation of the electromagnet array for editing the image of FIG. 4.

When the data is entered, the control system sets time intervals t3, t4, t5 shown in the timing chart of FIG. 6. These time intervals t3, t4, t5 are respectively equal to the time required for a point on the drum 1 to rotate by amounts corresponding to the distances X1, X2, X3.

Time intervals t1, t2 shown are respectively equal to the time taken for a point on the drum 1 to reach the developing stations P2, P3 of the first and second developing units **10*a*, 10*b* after passing through the exposure point P1. Time intervals t6, t7 are equal to the time taken for a point on the sleeves 20 in the developing units 10*a*, 10*b* to move from positions Q1, Q2 opposed to the arrays 30** to the developing stations P2, P3, respectively.

When the print switch is depressed with these initial settings, the drum 1 starts rotation a predetermined period of time thereafter in the direction of arrow a, and the components around the drum start operation.

At the same time, the unillustrated scan motor 46 is started up to drive the optical system 3 for the system to scan the document.

In the developing units **10*a*, 10*b*, the electromagnets 33 of the arrays 30 are all energized with the start of the rotation of the drum 1** to prevent the transport of the developers to the developing stations P2, P3.

The leading end of an electrostatic latent image corresponding to the front end Ao reaches the developing station P2 the period of time t1 after the actuation of the document end detecting switch **3*d***.

On the other hand, a point on the developing sleeve 20 in the first unit **10*a* corresponding to the front end Ao passes through the position Q1 opposed to the array 30 the period of time t6 therebefore, but since the magnets 33** are then in on state, the portion X1 of the image area B is not developed in color.

Subsequently, upon lapse of the time interval t1+t3 after the actuation of the switch **3*d* , the leading end A1 of the image area A reaches the developing station P2. In the first unit 10*a*, however, only the magnets 33** corresponding to the width Y2 are deenergized the time interval t6 therebefore.

Consequently, only the developer portion corresponding to the width Y2 is transported to the station P2, starting to develop the image area A.

These magnets 33 remain off for the period of time t4, during which the image area A is developed in color by the first unit 10*a*.

The latent image portion corresponding to the rear end A2 of the image area A thereafter reaches the developing station P2. However, the magnets 33 corresponding to the width Y2 are energized the period of time t6 therebefore, so that the image portion up to the rear end A3 over the distance X3 passes through the station P2 without being developed by the first unit 10*a*.

The period of time t2 after the actuation of the detecting switch 3*d*, the latent image portion corresponding to the document front end Ao reaches the developing station P3. On the other hand, the electromagnetic array 30 in the second unit 10*b* is entirely deenergized the period of time t7 therebefore.

Accordingly, the second unit 10*b* starts to develop with its block toner the image area B over the width X1.

The array 30 remains off for the time interval t3, and the magnets 33 corresponding to the width Y2 only are then energized to prevent the supply of the developer to the corresponding portion (corresponding to the image area A), and the developer is supplied to the portions at the opposite sides of the corresponding portion.

The magnets 33 corresponding to the width Y2 are deenergized the time interval t4 thereafter. The image area B over the distance X3 is thereafter developed with the black toner during the passage through the station P3, i.e. during the time interval t5.

Subsequently, the magnets 33 of the array 30 in the second unit 10*b* are all returned to on state.

In this way, the portions corresponding to the image areas A, B are developed with the color toner and the black toner, respectively, giving an image of different color areas.

The period of time t3+t4+t5 before preset automatic shutting-off, a paper discharge sensor is actuated, whereupon the copy paper S having the image transferred thereto by the foregoing copying operation is delivered onto the unillustrated discharge tray.

The document image can be copied on an enlarged or reduced scale by automatically selecting the magnet blocks 34 to be turned on or off and calculating the on-off timing in accordance with the magnification when the widths of different color areas of the document image are entered. When copies are made on a reduced scale, black striplike noises will occur in the background of the reduced image. However, images of high quality can be obtained free of this problem by turning on the magnets 33 corresponding to the background area to prevent the supply of the developer to this area.

Although the electromagnetic array 30 of the foregoing embodiment is turned on and off based on and as timed with the on signal from the document end detecting switch 3*d*, the use of the signal is not limitative but any signal is usable insofar as it is detectable during the period after the start of scanning by the optical system until the first magnet is turned on or off, i.e. during the period t1 -t6 in the foregoing embodiment. For example, a home position signal of the optical system is usable.

While the foregoing embodiment includes two developing units 10*a*, 10*b* around the photosensitive drum 1 to form images of two different color areas, this arrangement is not limitative; more developing units may be arranged to form images of more different color areas. The areas to be developed by the respective developing units may be overlapped for color mixing to obtain images having a larger number of different color areas than the number of developing units.

Figure 7:
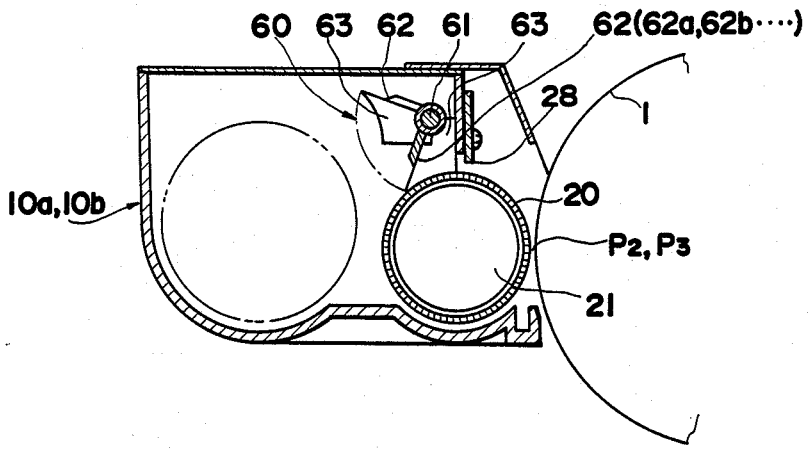
FIG. 7 is a sectional view showing a developing device according to a second embodiment of the invention.
Figure 8:
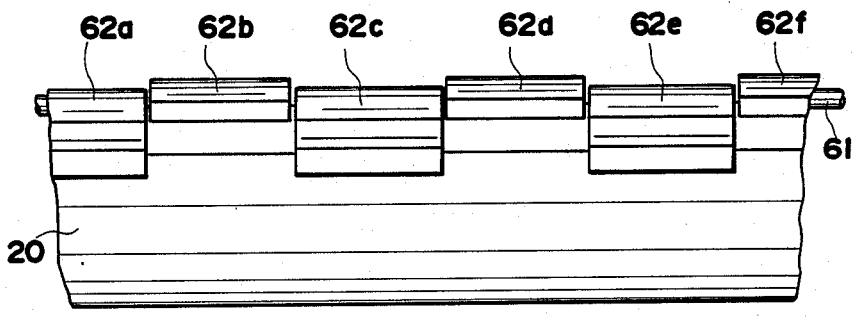
FIG. 8 is a front view of the scraper shown in FIG. 7.

Although the above embodiment includes the magnetic array 30 for removing the developer from the developing sleeve 20, the array 30 may be replaced by a removing assembly 60 as shown in FIGS. 7 and 8.

With reference to the removing assembly 60 shown in FIGS. 7 and 8, a support rod 61 is positioned above the developing sleeve 20 in front of the bristle height restricting plate 15 and extends in parallel to the sleeve 13.

A plurality of scrapers 62 (62*a*, 62*b*, ...) are rotatably mounted on the support rod 61 and are individually drivingly rotatable by respective electromagnetic clutches (not shown) into pressing contact with the surface of the developing sleeve 20 to scrape the developer off.

Each scraper 62 is provided at each of its opposite ends with a seal plate 63 for preventing the developer scraped off the developing sleeve 20 from moving to the rear side of the scraper 62. When one scraper 62 and another scraper 62 adjacent thereto are both in pressing contact with the sleeve 20, the seal plate 63 also serves to prevent the developer from passing through the clearance between the scrapers 62 and 62.

The removing assembly 60 of the above construction is attached to each of the first and second developing units 10*a*, 10*b*. The scrapers 62 of the first unit 10*a* and the scrapers 62 of the second unit 10*b* are positioned in the same relation with respect to the direction of rotation of the drum 1.

As is the case with the first embodiment, the scrapers 62 (62*a*, 62*b*, ...) are individually controlled for movement, whereby the image forming area of one developing unit is made to become the nonimage area of the other unit to form a pattern of different color areas.

A third embodiment of the invention will be described next with reference to FIGS. 9 to 12. The developing device of the third embodiment is substantially the same as the device of the first embodiment except that the electromagnetic arrays 30 of the first embodiment are replaced by developer removing assemblies 140*a*, 140*b*, so that with the exception of this feature, the second embodiment will not be described in detail.

Figure 9:
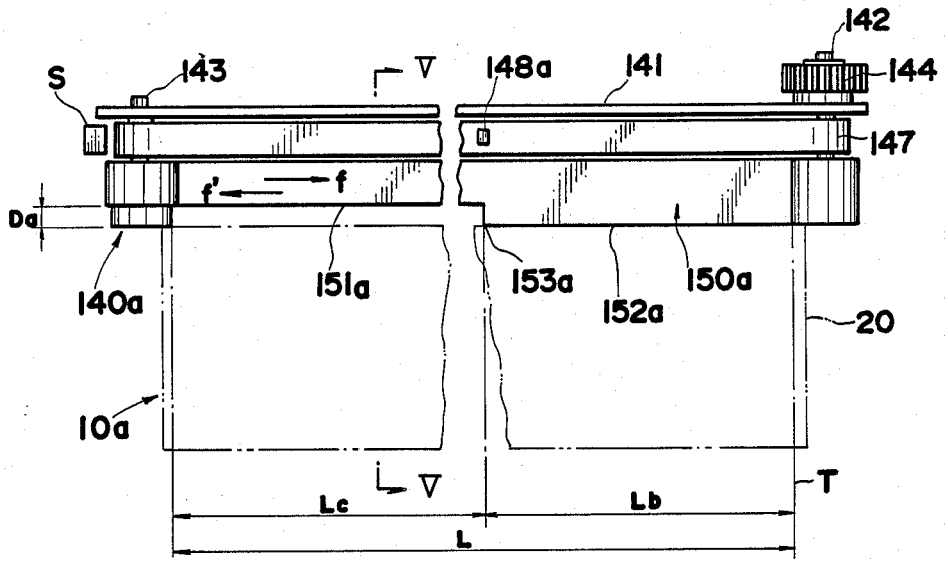
FIG. 9 is a front view of a developer removing assembly provided in a first developing unit according to a third embodiment of the invention.
Figure 10:
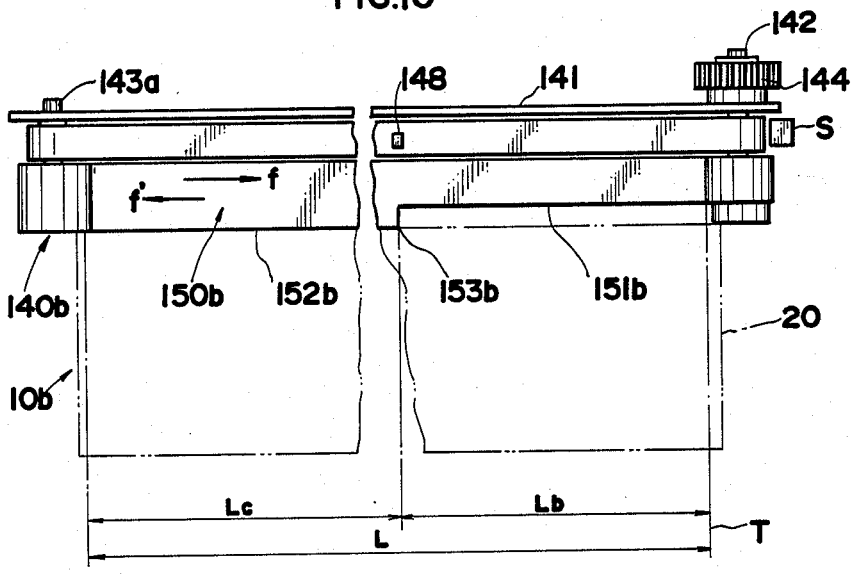
FIG. 10 is a front view of a developer removing assembly provided in a second developing unit according to the third embodiment of the invention.
Figure 11:
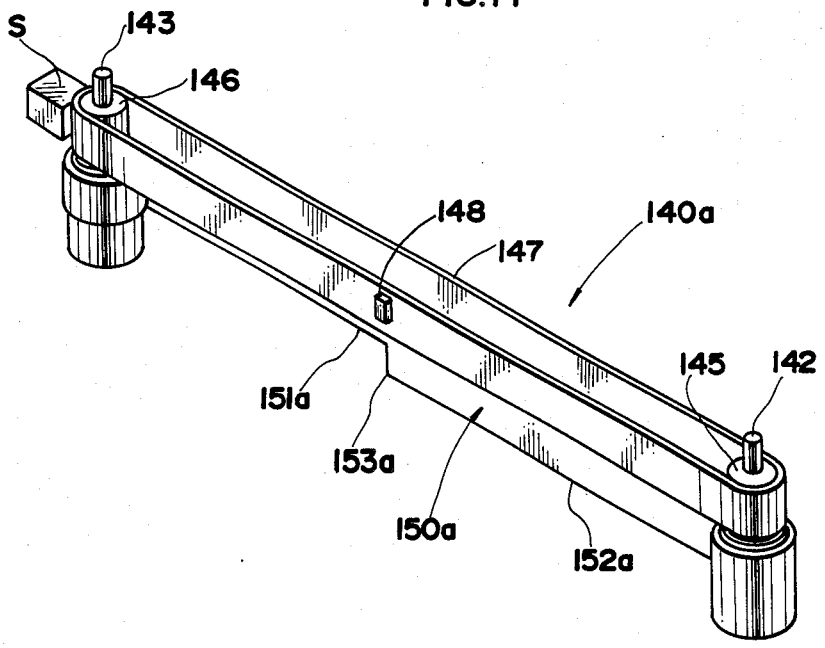
FIG. 11 is a perspective view of the developer removing assembly shown in FIG. 9.
Figure 12:
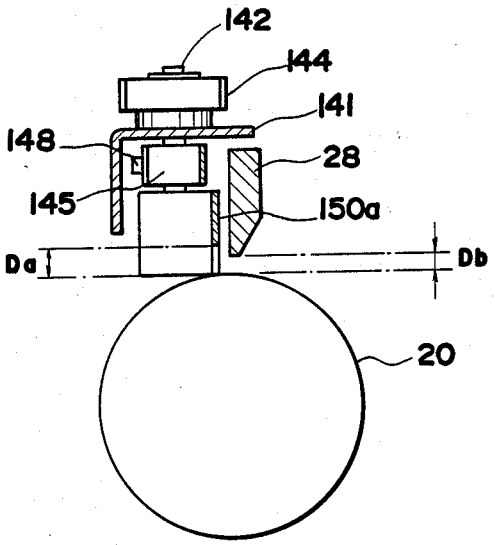
FIG. 12 is a view in section taken along the line V—V in FIG. 9 and showing the developer removing assembly.

FIGS. 9, 11 and 12 show the removing assembly 140*a* of the first developing unit 10*a*, and FIG. 10 the removing assembly 140*b* of the second unit 10*b*. The drawings of the second unit 10*b* corresponding to FIGS. 11 and 12 showing the first unit 10*a* are omitted.

Each of the removing assemblies 140*a*, 140*b* is disposed above the developing sleeve 20 between the bristle height restricting plate 28 and the bucket roller 22.

A support frame 141 extends along the sleeve 20 and rotatably carries shafts 142, 143 at its near and remote ends, respectively, each shaft having upper and lower ends projecting from the frame.

A gear 144 is fixedly mounted on the upper projection of the shaft 142 at the near end The gears 144 of the units 10*a*, 10*b* are driven by respective different stepping motors (not shown) The motors are so controlled as to rotate the gears 144 in the same direction in timed relation to each other.

As seen in FIG. 11, pulleys 145, 146 are fixed to the shafts 142, 142, respectively, at their lower projections. A drive belt 147 reeved around these pulleys 145, 146 has attached to its outer side a detection projection 148. A switch S is provided at the remote side of the first developing unit 10*a*, as well as at the near side of the second developing unit 10b. These switches S are connected to the control system, such that upon detecting the corresponding projection 148, the detection signal is fed to the control system.

A bristle cutting belt 150 is reeved around the lower ends of the shafts 142, 143 and positioned in close proximity to the restricting plate 28. The opposite ends of the belt 150 are wound around the shafts in opposite directions to each other. The belt 150 is made of a non-magnetic MYLAR, (polyester film) sheet or a thin metal sheet.

As seen in FIG. 9, the bristle cutting belt 150a of the first developing unit 10a is cut away at a remote portion thereof beyond its central portion (away from the plane of FIG. 11) from its lower edge to a height of Da to form an opening portion 151a, while the remaining near portion (from the central portion toward the plane of FIG. 11) serves as a contact portion 152a which is pressed into contact with the outer peripheral surface of the developing sleeve 20.

With reference to FIG. 10, the bristle cutting belt 150b of the other unit, i.e., the second developing unit 10b, is cut away at a near portion from its central portion toward the shaft 142 over an area of height Da to form an opening portion 151b, while the remaining remote portion (contact portion 152b) is pressed into contact with the outer peripheral surface of the sleeve 20.

The opening end (boundary 153a) of the first unit 10a and the boundary 153b of the second unit 10b are usually positioned in the same relation with respect to the direction of rotation of the photosensitive drum. However, they are overlapped in corresponding relation to a small amount of developer which will spread sidewise at the developing station at the edge of developer flow when the developer portion unremoved by each contact portion 152a or 152b is further transported on the developing sleeve 20.

Stated more specifically, when the boundary 153a of the first unit 10a is at a distance Lb from a reference line T of the image forming area L on the developing sleeve 20, the boundary 153b of the second unit 10b is also positioned approximately at the distance Lb from the reference line T. The opening portion 151a of the first unit 10a corresponds to the contact portion 152b of the second unit 10b, and the contact portion 152a of the first unit 10a corresponds to the opening portion 151b of the second unit 10b.

Accordingly, when the developing units 10a, 10b are driven with the removing assemblies 140a, 140b set in the state shown in FIGS. 9 and 10, respectively, the developer in the first unit 10a is scraped off by the contact portion 152a of the belt 150a over the distance Lb, with the result that only the developer portion corresponding to the opening portion 151a beyond the boundary 153a is transported toward the developing station P2. Conversely, the developer in the second unit 10b is transported toward the developing station P3 only over the distance of Lb from the reference line L, while the other developer portion beyond the boundary 153b is scraped off by the contact portion 152b of the belt 150b.

The boundaries 153a , 153b of the bristle cutting belts 150a, 150b are positioned in a specified relation with the positions of the projections 148, 148 of the drive belts 147, 147, respectively, such that the position of each boundary 153 can be detected indirectly by detecting the corresponding projection 148 by the switch S concerned.

When the first developing unit 10a is in such a state that the projection 148 is detected by its switch S, the contact portion 152a is in pressing contact with the developing sleeve 20 over the entire width of the image forming area L, with no developer supplied from the first unit 10a to the drum 1. The second unit 10b only then supplies its developer. Conversely, when the switch S of the second unit 10b detects its projection 148, the contact portion 152b is in pressing contact with the sleeve 20 over the entire width of the image forming area L, with the result that the first unit 10a alone supplies its developer to the drum 1.

The operation of the present embodiment will now be described.

Usually, black prints with use of black toner are most frequently used, so that when the copying machine is initially set for operation, the contact portion 152a of the first unit 10a is pressed against the sleeve 20 over the entire width of the image forming area L, while in the second unit 10b containing the black toner, the opening portion 151b is opposed to the image forming area L over the entire width thereof to supply the developer with the black toner from the second unit 10b only.

Figure 13A:
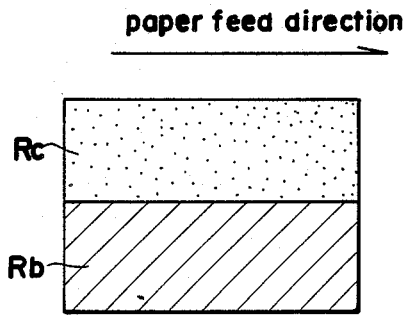
FIGS. 13 *a, b* and *c* are diagrams showing different modes image edition.

For example when an image of different color areas as shown in FIG. 13a is to be produced by the present embodiment, input keys on the operation panel are first depressed to specify the desired area, whereupon in response to signals from the control system, the motors provided for the developer removing assemblies 140a, 140b are driven each by a specified amount, moving the bristle cutting belts 150a, 150b in the direction of arrow f to position the boundaries 153a, 153b as specified.

In this state, the print switch is turned on, whereupon the developer with color toner is supplied to the sleeve 20 of the first unit 10a, and the developer with black toner is supplied to the sleeve 20 of the second unit 10b.

With reference to FIGS. 9 and 10, only the developer portion over the area Lc opposed to the opening 151a is sent to the developing station P2 of the first unit 10a. In the second unit 10b, on the other hand, only the developer portion in the area Lb opposed to the opening portion 151b is fed to the developing station P3.

Figure 13B:
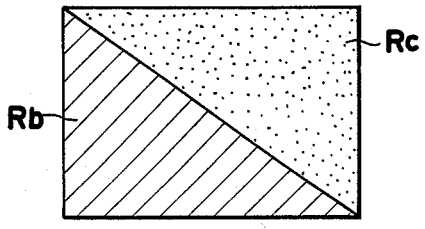
Figure 13C:
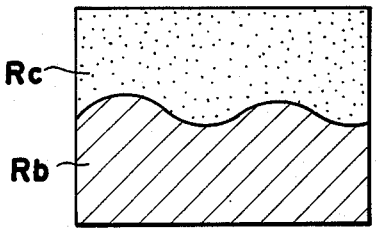

Consequently, the color toner only is supplied by the first unit 10a from the color print area Lc to the latent image on the drum 1 at the developing station P2, and the black toner only is supplied by the second unit 10b from the black print area Lb to the latent image at the station P3, whereby the copy image of different colors of FIG. 13 a can be obtained.

Unless the print switch is depressed for a given period of time after the completion of the color print, the motors operate to bring the removing assemblies to the initial state ready for producing black prints.

While the above description has been given with reference to the image of FIG. 13a having different color areas, the images of different color patterns of FIGS. 13 *b* and *c* can be produced by driving the bristle cutting belts 150a, 150b in timed relation in accordance with the size of copy paper and the transport speed of the paper (peripheral speed of the drum 1).

However, since the positions of the developing stations P2, P3 of the first and second units 10a, 10b are different with respect to the drum 1, overlapping of the black print area Rb and the color print area Rc or a clearance between the two areas should be avoided by driving one of the motors at an altered time.

Briefly stated, the developing units of the invention are each provided with means for axially locally impeding the flow of developer being transported over the peripheral surface of the developing sleeve, and these means are controlled as related to each other, whereby the document image can be developed only locally for the edition of an image.

This eliminates the necessity of practicing the image forming process twice or providing a returning path, enabling a compact image forming apparatus to have an image editing function without necessitating a very complex construction or an increased cost.

The copy paper, which needs to be passed through the image forming process only once, is less prone to mechanical or thermal stress in the meantime, therefore retains its quality and is less likely to jam the apparatus or to cause displacement of images.

Since edited images can be obtained within the same period of time as usual single-color copies, the apparatus of the invention retains the usual processing efficiency per unit time.

Furthermore, images with different color areas or having an area of mixed colors are available by using two or more developing units each having an electromagnetic array or scrapers and on-off controlling these means in synchronism. The copying machine, having the function of copying images of documents, can then be adapted to edit images of a wide variety of color patterns and are thereby given a greater commercial value.

While an eraser is usually used for preventing image formation in the interimage area of the photosensitive drum, the present invention is also useful for removing the developer from the developing sleeve at the portion thereof corresponding to the interimage area. The same result as is achieved by the eraser can then be obtained.

Generally, developing sleeves have a large width, whereas the width thereof acutally used for copying is limited. The present invention is also useful for removing the developer from the developing sleeve over the surface area thereof other than the portion corresponding to the image area. The developer removing means then serves the same function as the side eraser.

Furthermore, the developer can be removed from the surface of the developing sleeve at the portion thereof corresponding to the forward end of the document to be copied. This eliminates the problem that the toner adhering to the image leading end portion will be transferred to the rear side of copy paper and cause the paper to wind around the lower fixing roller during the fixing step, or will be transferred to the lower fixing roller to produce a streak on the rear side of the paper.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a rotatable photosensitive member having a photosensitive layer over its peripheral surface;

means for forming on the photosensitive member an electrostatic latent image corresponding to the desired image:

image editing means for specifying a first area of the desired image and a second area of the desired image different from said first area;

a first developing unit having a rotatable developing member for developing the latent image on the photosensitive member by bringing a developer being transported on the peripheral surface on the developing member into contact with the latent image:

first impeding means provided within said first developing unit for impeding the flow of the developer being transported on the peripheral surface of the rotatable developing member locally in the axial direction of the developing member;

a second developing unit having a rotatable developing member for developing the latent image on the photosensitive member by bringing a developer being transported on the peripheral surface of the developing member into contact with the latent image;

second impeding means provided within said second developing unit for impeding the flow of the developer being transported on the peripheral surface of the rotatable developing member locally in the axial direction of the developing member;

control means for driving the developing member of the first developing unit and the developing member of the second developing unit so as to develop the latent image; and associated control means, operative with said control means, for driving the first impeding means so as not to contact the developer with a first portion of the latent image corresponding to the first area specified by the image editing means and for driving the second impeding means so as not to contact the developer with a second portion of the latent image corresponding to the second area specified by the image editing means, said first portion and said second portion being located side by side in the axial direction of the photosensitive member.

2. An image forming apparatus as claimed in claim 1, wherein each of said first and second impeding means is positioned on the upstream side of a developing station where the sleeve is opposed to the photosensitive member with respect to the direction of rotation of the sleeve.

3. An image forming apparatus as claimed in claim 1, wherein either of said first and second impeding means includes an electromagnetic array opposed to the sleeve with a predetermined gap formed therebetween.

4. An image forming apparatus as claimed in claim 3, wherein said electromagnetic array includes a plurality of electromagnets which are individually magnetized or demagnetized in response to signals from the control means.

5. An image forming apparatus as claimed in claim 1, wherein either of said first and second impeding means includes a plurality of scrapers which are individually drivingly rotatable into pressing contact with the surface of the developing sleeve to scrape the developer off.

6. An image forming apparatus as claimed in claim 1, wherein either of said first and second impeding means includes a scraper which is contact with the surface of the developing sleeve and is movable in the axial direction of the developing sleeve.

7. An image forming apparatus comprising:

a platen on which an original is placed;

a rotatable photosensitive member having a photosensitive layer over its peripheral surface;

scanning means for scanning the original placed on the platen;

image processing means for projecting the original image scanned by said scanning means onto the photosensitive member to form an electrostatic laten image thereon;

image editing means for specifying a first area of said original image and a second area of said original image different from said first area, said first area and said second area being located side by side in the direction perpendicular to the scanning direction;

a first developing unit having a rotatable developing member for developing the latent image on the photosensitive member by bringing a developer being transported on the peripheral surface of the developing member into contact with the latent image;

first impeding means provided within said first developing unit for impeding the flow of the developer being transported on the peripheral surface of the rotatable developing member locally in the axial direction of the member;

a second developing unit having a rotatable developing member for developing the latent image on the photosensitive member by bringing a developer being transported on the peripheral surface of the developing member into contact with the latent image;

second impeding means provided within said second developing unit for impeding the flow of the developer being transported on the peripheral surface of the rotatable developing member locally in the axial direction of the developing member;

control means for driving the developing member of the first developing unit and the developing member of the second developing unit for equal time intervals so as to develop the latent image; and associated control means, operative with said control means, for driving the first impeding means so as not to contact the developer with the latent image at least at a first portion thereof corresponding to the first area specified by the image editing means and for driving the second impeding means so as not to contact the developer with the latent image at least at a second portion thereof corresponding to the second area specified by the image editing means.

8. An image forming apparatus comprising:

a rotatable photosensitive member having a photosensitive layer over its peripheral surface;

means for forming on the photosensitive member an electrostatic latent image corresponding to the desired image;

image editing means for specifying an optional area of the desired image;

a first developing unit having a developing roller for developing the latent image on the photosensitive member by bringing a developer being transported on the peripheral surface of the roller into contact with the latent image;

first impeding means provided within said first developing unit for impeding the flow of the developer being transported on the peripheral surface of the developing roller locally in the axial direction of the roller;

a second developing unit having a developing roller for developing the latent image on the photosensitive member by bringing a developer being transported on the peripheral surface of the roller into contact with the latent image;

second impeding means provided within said second developing unit for impeding the flow of the developer being transported on the peripheral surface of the developing roller locally in the axial direction of the roller;

a first bristle height restricting plate provided within said first developing unit and a second bristle height restricting plate provided within said second developing unit, the first impeding means provided adjacent to the first restricting plate and the second impeding means provided adjacent to the second restricting plate so as to be on an upstream side thereof with respect to rotational direction of the roller of said first developing unit and the roller of said second developing unit, respectively;

a control means for driving the roller of the first developing unit and the roller of the second developing unit for equal time intervals so as to develop the latent image; and associated control means, operative with said control means, for driving the first impeding means so as to contact the developer with the latent image only at a portion thereof corresponding to the area specified by the image editing means and for driving the second impeding means so as not to contact the developer with the latent image at least at the portion thereof corresponding to the specified area.

9. An image forming apparatus comprising:

a platen on which an original is placed;

a rotatable photosensitive member having a photosensitive layer over its peripheral surface;

scanning means for scanning the original placed on said platen;

image processing means for projecting the original image scanned by said scanning means onto the photosensitive member to form an electrostatic latent image thereon;

image editing means for specifying an optional area of said original image;

a first developing unit having a developing roller for developing the latent image on the photosensitive member by bringing a developer being transported on the peripheral surface of the roller into contact with the latent image;

first impeding means provided within said first developing unit for impeding the flow of the developer being transported on the peripheral surface of the developing roller locally in the axial direction of the roller;

a second developing unit having a developing roller for developing the latent image on the photosensitive member by bringing a developer being transported on the peripheral surface of the roller into contact with the latent image;

second impeding means provided within said second developing unit for impeding the flow of the developer being transported on the peripheral surface of the developing roller locally in the axial direction of the roller;

a first bristle height restricting plate provided within said first provided unit and a second bristle height restricting plate provided within said second developing unit, the first impeding means provided adjacent the first restricting plate and the second impeding means provided adjacent the second restricting plate so as to be on an upstream side thereof with respect to rotational direction of the roller of said first developing unit and the roller of said second developing unit, respectively;

a control means for driving the roller of the first developing unit and the roller of the second developing unit for equal time intervals so as to develop the latent image; and associated control means, operative with said control means, for driving the first impeding means so as to contact the developer with the latent image only at a portion thereof corresponding to the area specified by the image editing means and for driving the second impeding means so as not to contact the developer with the latent image at least at the portion thereof corresponding to specified area.

10. An image forming apparatus comprising:

a rotatable photosensitive member having a photosensitive layer over its peripheral surface;

means for forming on the photosensitive member an electrostatic latent image corresponding to the desired image;

image editing means for specifying an optional area of the desired image;

a first developing unit having a developing roller for developing the latent image on the photosensitive member by bringing a developer being transported on the peripheral surface of the roller into contact with the latent image;

first impeding means provided within said first developing unit for impeding the flow of the developer being transported on the peripheral surface of the developing roller locally in the axial direction of the roller;

a second developing unit having a developing roller for developing the latent image on the photosensitive member by bringing a developer being transported on the peripheral surface of the roller into contact with the latent image;

second impeding means provided within said second developing unit for impeding the flow of the developer being transported on the peripheral surface of the developing roller locally in the axial direction of the roller;

first control means for driving the roller of the first developing unit and the roller of the second developing unit simultaneously so as to develop the latent image;

second control means for driving the first impeding means so as to contact the developer with the latent image only at a portion thereof corresponding to the area specified by the image editing means and for driving the second impeding means so as not to contact the developer with the latent image at least at the portion thereof corresponding to the specified area; and wherein either of said first and second impeding means includes a plurality of scrapers which are individually drivingly rotatable into pressing contact with the surface of the developing sleeve to scrape the developer off.

* * * * *